US010681939B2

(12) United States Patent
DeSimone

(10) Patent No.: US 10,681,939 B2
(45) Date of Patent: Jun. 16, 2020

(54) STABILIZED GARMENT CUFF

(71) Applicant: Michael DeSimone, Cold Spring Harbor, NY (US)

(72) Inventor: Michael DeSimone, Cold Spring Harbor, NY (US)

(73) Assignee: Michael DeSimone, Cold Spring Harbor, NY (US)

( * ) Notice: Subject to any disclaimer, the term of this patent is extended or adjusted under 35 U.S.C. 154(b) by 103 days.

(21) Appl. No.: 15/982,115

(22) Filed: May 17, 2018

(65) Prior Publication Data

US 2019/0350269 A1 Nov. 21, 2019

(51) Int. Cl.
*A41B 7/00* (2006.01)
*A41D 27/10* (2006.01)

(52) U.S. Cl.
CPC ..... *A41B 7/00* (2013.01); *A41D 27/10* (2013.01)

(58) Field of Classification Search
CPC .... A41B 7/00; A41B 7/02; A41B 1/00; A41D 27/06; A41D 27/10; A41F 17/00; A41F 19/005
USPC ..... 2/69, 115, 123, 125, 126, 166, 170, 231, 2/232, 269, 311
See application file for complete search history.

(56) References Cited

U.S. PATENT DOCUMENTS

2006/0053526 A1* 3/2006 Beland ..... A41D 13/0015 2/115
2006/0200890 A1* 9/2006 Prat Gonzalez ..... A41D 7/00 2/69
2006/0260025 A1* 11/2006 Voege ..... A41D 1/04 2/269
2007/0157369 A1* 7/2007 Uchibori ..... A41B 7/08 2/255
2011/0131707 A1* 6/2011 Sauer ..... A61F 2/78 2/270
2012/0180181 A1* 7/2012 Best ..... A41D 27/10 2/16
2013/0254967 A1* 10/2013 Tiemann ..... A41D 13/0015 2/69
2016/0167344 A1* 6/2016 Arici ..... C09J 153/025 2/115
2018/0271192 A1* 9/2018 Parriott ..... A41D 27/20

FOREIGN PATENT DOCUMENTS

WO WO 2018/152215 * 8/2018 ..... A41B 7/00

* cited by examiner

*Primary Examiner* — Katherine M Moran
(74) *Attorney, Agent, or Firm* — Dilworth & Barrese, LLP

(57) ABSTRACT

An improved garment, such as a shirt, is provided that can comfortably grip a wearer's body and remain in place, even if the wearer is engaged in physical activity. A preferred fabric for garments in accordance with the invention is spandex, a polyether-polyurea copolymer also known as elastane. When is the garment is a shirt, the shirt cuffs can be provided with a band of silicone on the inner surface of the cuffs. The band can be formed as stripes, dots or patches to form a uniform gripping surface around the wearer's arm.

17 Claims, 2 Drawing Sheets

STABILIZED GARMENT CUFF

TECHNICAL FIELD

The present disclosure relates generally to garments, and more particularly, to a shirt with a cuff that will stay in place in a comfortable, non-restrictive manner, even while the user is engaged in vigorous physical activities.

BACKGROUND

Many garments, such as shirts, attempt to strike a balance between comfort and function. For example, loose fitting garments can be more comfortable than tight fitting garments. However, a loose fitting garment can sometimes be more restrictive than a tight fitting, but more stretchable garment, because the shifting of loose fabric can impair movement and serve as a distraction. Clothing that is too loose can cause physical harm from tripping or catching. Therefore, it can be desirable for active-wear to be close fitting, but stretchable, so as not to interfere with body movement.

One drawback to close fitting stretchable clothing is the tendency to bunch-up during movement activity. For example, the cuffs of close fitting shirts often "ride up" a wearer's arms when the hands are moved over the head. In other garments, "pushed-up" sleeves will not stay up because the garment is too stretchable. Thus, some garments will not stay down even after the arms are lowered. This is undesirable, as a wearer must constantly tug the sleeves back to their original position after the cuffs ride up the arms during movement and then stay in the bunched up condition. Pushed up sleeves will not stay up, and need to constantly be pushed back up. Thus, if a wearer is engaged in a messy activity, such as fish cleaning or needs to reach into water, it is desirable for a cuff to stay up and not slide down during use.

One solution for keeping shirt cuffs in place has been to include a loop, to engage a wearer's hand. Other solutions involve restrictive bands. Other attempted solutions have been found to be uncomfortable. None of the current solution have been found to be fully satisfactory.

Accordingly, it is desirable to provide an improved garment, such as a shirt, that overcomes deficiencies in the prior art.

SUMMARY

Generally speaking, in accordance with the invention, an improved garment is provided that can comfortably grip a wearer's body and remain in place, even if the wearer is engaged in physical activity. A preferred fabric for garments in accordance with the invention is stretchable, such as spandex, a polyether-polyurea copolymer also known as elastane. When the garment is a shirt, the cuffs can be provided with a band of silicone on the inner surface of the cuffs. The band is preferably 0.25 to 2.0 cm, more preferably 0.67 to 1.5 cm, most preferably 0.8 to 1.2 cm wide. The silicone can have a thickness of about 0.04 to 0.08 cm, preferably 0.06 to 0.07 cm. The band can be formed as a single band, stripes, dots or patches to form a uniform gripping surface around the wearer's arm. The cuff is preferably formed as a double layer of stretchable fabric, to provide extra security against the arm.

Other embodiments of the invention will be apparent from the drawings and the specification to follow and the scope of the invention will be indicated in the claims.

BRIEF DESCRIPTION OF THE DRAWINGS

The present disclosure will become more readily apparent from the specific description, accompanied by the following drawings, in which.

Throughout the disclosure, like reference numerals will be used to indicate similar elements.

DETAILED DESCRIPTION OF PREFERRED EMBODIMENTS

Figure 1:
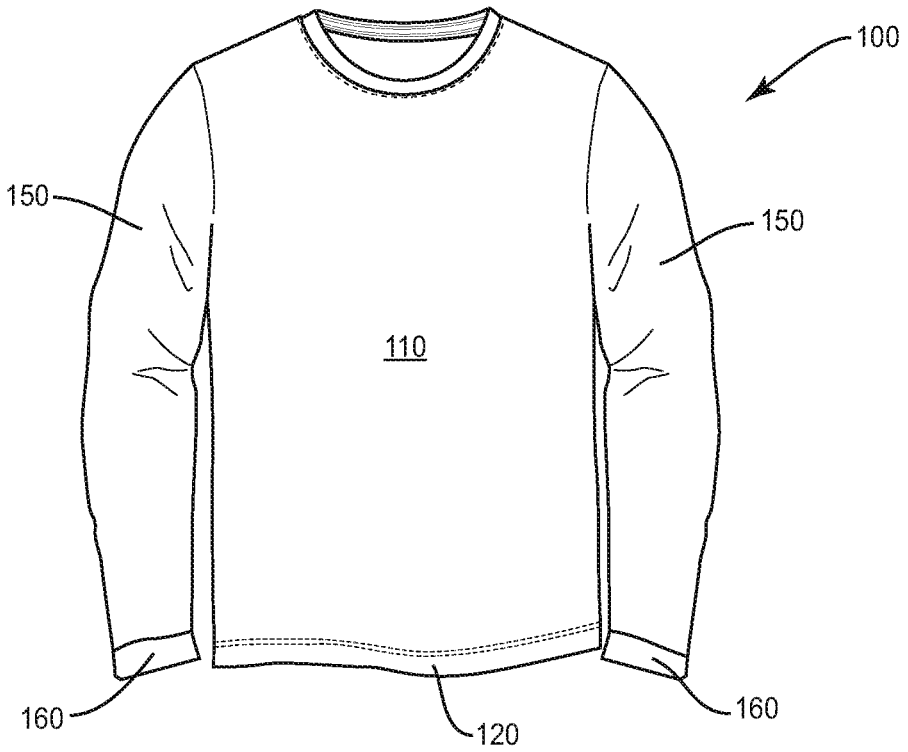
FIG. 1 is a front perspective view of a shirt, constructed in accordance with a preferred embodiment of the invention.
Figure 2:
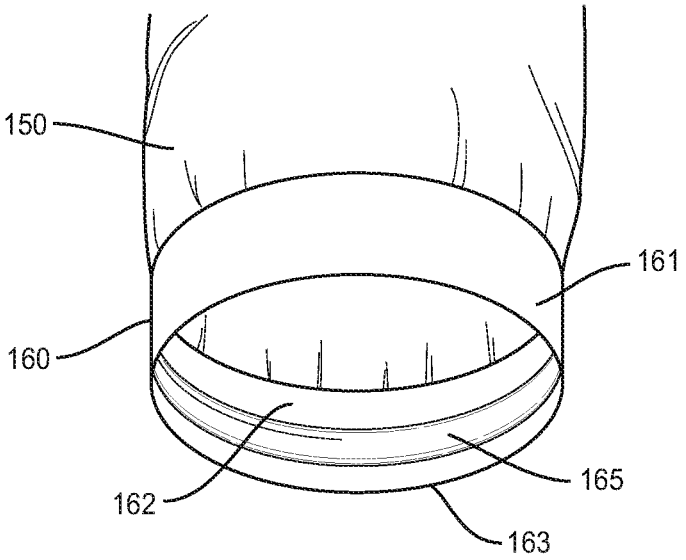
FIG. 2 is an enlarged perspective view of the cuff of the shirt of FIG. 1, in accordance with a preferred embodiment of the invention.

The present disclosure may be understood more readily by reference to the following detailed description, taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments, by way of example only, and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. In particular, they are intended to refer to the spatial reference of the display stand in its normal, assembled configuration during intended use.

Garments in accordance with preferred embodiments of the invention can comfortably grip a wearer's body and remain in place, even if the wearer is engaged in physical activity. A preferred stretchable fabric for garments in accordance with the invention is spandex, a polyether-polyurea copolymer also known as elastane. Preferred silicone's include high density silicone-gel adhesives. These can be applied to the material of the inner cuff, in a heat-press process.

In a preferred embodiment of the invention, the cuff is formed as a double layer of stretchable material, such as spandex, folded at its outer edge and sewn to the sleeve at its inner edge. To form the cuff, a strip of silicone adhesive can be heat pressed onto a strip of fabric. The strip can be folded in the lengthwise direction to form a double layer of fabric with a strip of silicone adhesive near the fold, preferably 0.25 to 1.0 cm from the edge. The double layer strip can be cut to length and formed into a circular cuff, sewn to the end of each sleeve.

Silicones, also known as polysiloxanes, especially polymethyl siloxanes are synthetic polymers made up of repeating units of siloxane, which is a chain of alternating silicon atoms and oxygen atoms. The siloxane units are frequently combined with carbon or hydrogen or both. Strips of silicone adhesive are advantageous. Preferred silicones are water resistant, sweat resistant, biocompatible and hypoallergenic. They are available as smooth tapes, which feel comfortable (grippy, but not sticky) against the skin.

When the garment is a shirt, the cuffs can be provided with a band of silicone on the inner surface of the cuffs. The band can be formed as stripes, dots or patches to form a uniform gripping surface around the wearer's arm. In a long sleeve shirt embodiments of the invention, the shirt is sized so that the band will engage a wearer's wrist. In shorter "baseball" length shirts, the shirt is sized to engage a wearer's forearm. In short sleeve embodiments, the shirt is sized so that the band will engage a wearer's upper arm. Bands of silicone in accordance with the invention are elastic and provide an optimal gripping surface to keep a shirt cuff in place, even as the arms are engaging active physical activities. In preferred embodiments, the cuff will stay in place with respect to the arm even after a wearer raises their hands over their head then lowers their hands to their waist five times. In another embodiment of the invention, a cuff of a shirt pushed up, over the elbow, will remain above the elbow, even when a wearer bends and extends their arms five times.

The following example of a garment in accordance with the invention is provided for purposes of illustration only and is not intended to be construed as limiting.

A garment in accordance with a preferred embodiment of the invention is shown generally in FIG. 1 as a shirt 100. Shirt 100 includes a body portion 110 and a pair of sleeves 150 extending from body portion 110. Body portion 110 includes a lower border 120. Lower border 120 is preferably a folded, sewn, double layer of the fabric of body portion 110. Lower border 120 is preferably about 1 to 3 cm wide.

Sleeves 150 includes a pair of cuffs 160. Cuffs 160 are preferably a double layer of fabric. The fabric is advantageously less elastic (less stretchy) than the fabric of body portion 110, to form a tighter grip on the wearer's arm than the remainder of the sleeve. Cuffs 160 include an outer surface 161 and an inner surface 162. A gripping band 165 is provided on inner surface 162. Gripping band 165 can be provided as a 1 cm wide, 2 mm high, 0.025 inch deep strip of high density silicone gel adhesive. It can be applied to inner surface 162 with a heat press.

Gripping band 165 is preferably about 0.25 to 2.0 cm, more preferably about 0.6 to 1.5 cm, most preferably about 0.8 to 1.2 cm wide. The silicone can have a thickness of about 0.04 to 0.08 cm, preferably about 0.06 to 0.07 cm. Gripping band 165 is preferably spaced about 0.5 cm from an edge 163 of cuff 160. In preferred embodiments of the invention, gripping band 165 is spaced about 0.5 to 1.0 cm from edge 163.

Figure 3:
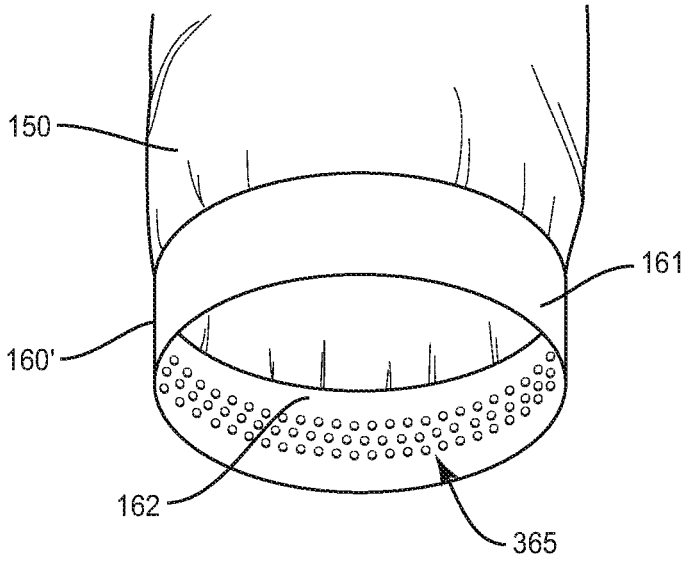
FIG. 3 is an enlarged perspective view of the cuff of the shirt of FIG. 1, in accordance with another preferred embodiment of the invention.

A cuff in accordance with another preferred embodiment of the invention is shown generally in FIG. 3, as a cuff 160'. Cuff 160' is similar in construction to cuff 160. However, cuff 160' includes a broken gripping band 365 having islands of silicone, rather than a single strip. Broken gripping band 365 is generally similar to gripping band 165, but is segmented into individual domains, rather than comprising a uniform band. The domains are preferably uniform in size and uniformly distributed on the inner surface 162 of cuff 160. However, the size and spacing can be non-uniform. In FIG. 3, broken gripping band 365 is shown as three rows of dots, comprising about nine dots per square centimeter. In other embodiments of the invention, the band can comprise as many as 10 rows and 100 dots per square centimeter. In a preferred embodiment of the invention, the broken gripping band can comprise 8 rows, comprising about 64 dots per square centimeter.

Broken gripping band 365 can be formed from the same material as gripping band 165. It can be provided as a 1 cm wide, 2 mm high, 0.025 inch deep dotted strip of high density silicone gel adhesive. It can be applied to inner surface 162 with a heat press.

In one embodiment of the invention, the cuff portion is formed as a flat strip of fabric and a strip of silicone adhesive is applied, by hot pressing to that flat strip. The ends of the flat strip are then joined, to form a circular cuff, with the silicone band on the inner surface of the cuff. This cuff is joined to the sleeve of the shirt. The order of attachment is not critical. In a preferred embodiment of the invention, the cuff is formed of a double layer of fabric, preferably spandex and preferably less stretchy than the fabric of body portion 110.

A shirt, in accordance with preferred embodiments of the invention can be constructed and arranged to grip the skin of an average individual wearing the shirt and maintain the position of the shirt with respect to the wearer's arms. In one embodiment of the invention, this means staying down, in the extended position while the wearer raises their hands over their head and lowers their hands to their waist at least five times, without needing to readjust the sleeves. In another embodiment of the invention, if an average wearer pushes the sleeve from the wrist to above the elbow, the sleeve will stay over the elbow after the wearer bends and extends their arms five times. As used herein, the average individual is arbitrarily designated as a male, 5'11" to 6'1" and weighs 175 to 200 lbs. A preferred cuff for the average wearer is about 22 to 24 cm in circumference. Of course, differently sized shirts can be constructed to fit differently sized wearers.

In still another embodiment of the invention, a gripping band (not shown) can be formed on the inner surface of the lower border 120. This gripping band can be similar in structure to gripping bands 165 or 365. This band will help keep the shirt from coming untucked during physical activity.

While the preferred embodiments of the invention have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims.

What is claimed is:

1. A shirt, comprising:

a fabric body portion and two stretchable fabric sleeves extending from a top of the body portion, a majority of each sleeve formed with spandex and each sleeve having a top end attached to the body portion and a cuff at the opposite lower end;

each cuff having an outer surface and an inner surface, the inner surface configured and adapted to contact the skin of a wearer, each cuff is formed from a two layer strip of fabric formed with spandex and is less elastic than the sleeve; and a band of silicone bonded to the inner surface of the cuff adapted to form a uniform gripping surface against a wearer's arm and resist movement of the band with respect to the wearer's arm.

2. The shirt of claim 1, wherein the band is elastic and comprises high density silicone gel adhesive.

3. The shirt of claim 1, wherein the band is elastic and about 0.25 to about 2.0 cm wide.

4. The shirt of claim 1, wherein the band is about 0.67 to 1.5 cm wide.

5. The shirt of claim 4, wherein the band has a thickness of about 0.04 to 0.08 cm.

6. The shirt of claim 4, wherein the band has a thickness of about 0.06 to 0.07 cm.

7. The shirt of claim 4, wherein the band comprises uniformly distributed silicone islands.

8. The shirt of claim 7, comprising about 9 to 100 islands per square centimeter.

9. The shirt of claim 1, wherein the band is a high density silicone gel adhesive about 0.8 to 1.2 cm wide.

10. The shirt of claim 1, wherein the sleeves and cuffs are formed of spandex.

11. The shirt of claim 1, wherein the cuffs are 22 to 24 cm in circumference and the bands are adapted to grip the arm skin of an average individual wearing the shirt and maintain the position of the cuffs with respect to the wearer's arms, while the individual raises their hands over their head and lowers their hands to their waist five times.

12. The shirt of claim 1, wherein the cuffs are 22 to 24 cm in circumference and the bands are adapted to grip the arm skin of an average individual wearing the shirt and maintain the position of the cuffs above a wearer's elbow, after being pushed from below the elbow to above the elbow, and stay above the elbow, while the individual bends and extends their arms five times.

13. A shirt, comprising sleeves, a majority of each sleeve formed with spandex and each sleeve having an upper portion and a lower portion and a cuff on the lower portion, each cuff having an inner surface configured and adapted to contact the skin of a wearer, each cuff formed from a two layer strip of fabric formed with spandex and is less elastic than the sleeve, a band of silicone on an inner surface of each cuff, the band adapted to grip the arm skin of an average individual wearing the shirt and wherein the bands are positioned and adapted to grip the arm skin of an average individual wearing the shirt and maintain the position of the band with respect to the wearer's arm while the individual bends and extends their arms five times.

14. The shirt of claim 13, wherein the bands of silicone are about 0.67 to 1.5 cm wide.

15. The shirt of claim 14, wherein the bands adapted to grip the skin of an average individual wearing the shirt and maintain the position of the cuffs with respect to the wearer's arms, while the wearer raises their hands over their head and lowers their hands to their waste five times.

16. The shirt of claim 13, wherein the bands of silicone are about 0.06 to 0.07 cm thick.

17. A shirt, comprising:

a fabric body portion and two fabric sleeves extending from a top of the body portion, from a top portion of each sleeve to a lower portion of each sleeve, a majority of each sleeve formed with spandex;

the lower portion of each sleeve having a cuff with an inner surface, the inner surface of each cuff configured and adapted to contact the skin of a wearer, each cuff is formed from a two layer strip of fabric formed with spandex and is less elastic than the sleeve; and a stretchable band of silicone bonded to the inner surface of each cuff, the band adapted to form a gripping surface against a wearer's arm and resist movement of the band with respect to the wearer's arm.

* * * * *